US006090228A

United States Patent [19]

Hwang et al.

[11] Patent Number: 6,090,228

[45] Date of Patent: Jul. 18, 2000

[54] ANTICORROSIVE TREATMENT METHOD FOR A SEPARATOR OF MOLTEN CARBONATE FUEL CELL

[75] Inventors: Jung-Tae Hwang; Young-Tae Choi; Si-Yeog Ryu, all of Taejeon, Rep. of Korea

[73] Assignee: Samsung Heavy Industries Co., Ltd., Seoul, Rep. of Korea

[21] Appl. No.: 08/864,745

[22] Filed: May 29, 1997

[30] Foreign Application Priority Data

May 31, 1996 [KR] Rep. of Korea ..... 96-19359
Jun. 19, 1996 [KR] Rep. of Korea ..... 96-22386
Jun. 19, 1996 [KR] Rep. of Korea ..... 96-22387

[51] Int. Cl.[7] ..... C23C 4/18; C23C 16/56; C23C 18/31

[52] U.S. Cl. ..... 148/518; 148/530; 148/531; 148/535; 429/34

[58] Field of Search ..... 148/512, 518, 148/530, 531, 535; 429/34

[56] References Cited

U.S. PATENT DOCUMENTS 4,150,178 4/1979 Yagi et al. ..... 148/531

FOREIGN PATENT DOCUMENTS 54-8169 4/1979 Japan ..... 148/531
2-282465 11/1990 Japan ..... 148/531

*Primary Examiner*—George Wyszomierski
*Attorney, Agent, or Firm*—Dilworth & Barrese

[57] ABSTRACT

An anticorrosive treatment method for a separator of a molten carbonate fuel cell is provided. As conventional anticorrosive treatment methods for a wet-seal area in an separator, there are a molten aluminium coating method, a physical vapor deposition method, a slurry coating method, a spray coating method, a pack cementation method and a vacuum evaporation method. Defects due to high temperature thermal treatment corrodes even stainless steel base materials to thus shorten the lifetime of the fuel cell. Further, to sufficiently assure an anticorrosive capability of the separator wet-seal area, a coating ratio should be heightened finally, which makes fabrication of the large-area separator difficult, and manufacturing costs high. To solve the conventional problems, nickel and aluminium are coated in turn on a base material of stainless steel or an thin aluminium film is coated or bonded thereon to then perform diffusion process, which simplifies a manufacturing process and lowers a manufacturing cost. Since the coating is accomplished by diffusion, a coating layer having an excellent anticorrosive capability and junction ability with respect to the base material can be obtained. The anticorrosive capability can be maintained even in the high temperature carbonate due to the long lifetime of the fuel cell.

9 Claims, 4 Drawing Sheets

ANTICORROSIVE TREATMENT METHOD FOR A SEPARATOR OF MOLTEN CARBONATE FUEL CELL

BACKGROUND OF THE INVENTION

The present invention relates to an anticorrosive treatment method for a separator of a molten carbonate fuel cell, and more particularly, to an anticorrosive treatment method for a separator of a molten carbonate fuel cell which improves an anticorrosive capability with respect to an electrolyte and prevents deformation of the molten fuel cell at the time of heat treatment, by coating nickel and aluminium in turn or only aluminium on a base material of a stainless steel, or by bonding an aluminium thin film thereon and then performing a diffusion processing thereto.

Generally, a molten carbonate fuel cell generates an electrical energy in used as an oxidizing agent, both mutually react, and hydrogen contained in the fuel and oxygen contained in the oxidizing agent mutually electrochemically react. The molten carbonate fuel cell is regarded as a fourth electric power following hydraulic, thermal, and atomic electric power. Such a fuel cell directly converts chemical energy of the reacting materials into electrical energy, to guarantee high efficiency as well as low pollution.

A general structure of the fuel cell will be described below. FIG. 1 shows a general molten carbonate fuel cell, which purposes for explaining an inner layer structure and driving mechanism of the molten carbonate fuel cell. As shown in FIG. 1, the fuel cell includes electrodes 10*a* and 10*b* composed of a anode electrode and an cathode electrode between which an electrochemical reaction is performed, matrixes 20*a* and 20*b* interposed between the electrodes in order to contain and support an molten carbonate of a electrolyte, current collectors 30*a* and 30*b* for smoothing the movement of electrons generated from the reaction, and separators 40*a* and 40*b* for providing entry and exit of reaction gases and an electric current path. The electrodes 10*a* and 10*b* use nickel-chromium (Ni—Cr) as an anode electrode and nickel oxide (NiO) as a cathode electrode. A mixed carbonate consisting of 62% by mole of $Li_2CO_3$ and 38% by mole of $K_2CO_3$ is used as the electrolyte. Lithiumaluminate ($LiAlO_2$) is used as the matrixes 20*a* and 20*b*. It is appropriate to use stainless steel such as AISI 316L and AISI 310S as the material of the separators 40*a* and 40*b*.

However, in the case of the above molten carbonate fuel cell, nickel oxide of the cathode electrode is dissolved and corroded by reaction with the electrolyte in the cathode electrode contacting thereto, to bitterly cause loss of the electrolyte. Particularly, the molten carbonate fuel cell operates at a high temperature of 650° C., to accordingly corrode a wet-seal area contacting the electrolyte on the separator severely. Such a corrosion causes the electrolyte to be consumed. As a result, cross-over of the reaction gases and the short-circuit of the cell due to the corrosion products results in deterioration of the performance of the cell and shortening of the lifetime thereof.

Accordingly, to solve the above problems, aluminium coating has been performed on the wet-seal area of the fuel cell, which is regarded as the best anticorrosive coating method. As general aluminium coating methods, there are a molten aluminium coating method in which a base material is dipped into the molten aluminium, and a calorizing method in which Al, $NH_4Cl$, and $Al_2O_3$ are mixed and thermally treated to then diffuse Al into the base material. Besides, there are a physical vapor deposition method for evaporating aluminium and depositing it on the base material, a slurry coating method for coating slurry obtained by mixing aluminium powder with various solvents on the base material, a spray coating method for spraying aluminium onto the base material.

The above-described general aluminium coating methods perform a diffusion thermal treatment at 900° C. or more. In this case, since the separator is thin, the high temperature heat generated during operation of the fuel cell deforms the plates. Also, defects due to high temperature thermal treatment cause to corrode even the base materials of stainless steel, to be shortened the lifetime of the fuel cell thereby. Further, unless the aluminium is coated by a predetermined thickness or more (minimum 30 $\mu$m), an anticorrosive capability cannot be enough for. To prevent this, a coating ratio should be heightened finally, which makes fabrication of the large-area separator difficult, and manufacturing costs high.

SUMMARY OF THE INVENTION

To solve the above problems, it is an object of the present invention to provide an anticorrosive treatment method for a fuel cell separator in which coating of a large-area separator is freely accomplished in simplified processes.

It is another object of the present invention to provide an anticorrosive treatment method for a fuel cell separator in which deformation of a thin separator is minimized during diffusion thermal treatment, to have a high correction protective property.

It is further object of the present invention to provide an anticorrosive treatment method for a fuel cell separator in which deformation of an separator is prevented by diffusion thermal treatment at optimal temperature and atmosphere, durability of that is improved.

To accomplish the above object of the present invention, there is provided an anticorrosive treatment method for a base material which is adopted as separating means, for use in a molten carbonate fuel cell including a manifold portion for making gases flow therethrough, electrodes and a gas sealing portion for sealing to prevent gases from leaking, the anticorrosive treatment method comprising the steps of:

plating a base material composed of a stainless steel plate with a nickel having a predetermined thickness;

bonding a thin aluminium film having a thickness of from about 5 $\mu$m to about 20 $\mu$m on a gas sealing portion of the nickel-plated base material; and thermally treating the resultant material in a hydrogen gas atmosphere to form a metal compound of the nickel and aluminium by diffusion at the junction surfaces between the base material, the nickel and the aluminium.

To accomplish other object of the present invention, there is also provided an anticorrosive treatment method for a base material which is adopted as separating means, for use in a molten carbonate fuel cell including a manifold portion for making gases flow therethrough, electrodes and a gas sealing portion for sealing to prevent gases from leaking, the anticorrosive treatment method comprising the steps of:

coating a base material which is composed of a stainless steel plate and has a predetermined width with aluminium by the thickness of 10–500 $\mu$m; and thermally treating the resultant material for 1–20 hours in a hydrogen-atmosphere of 10–50% at temperatures of 600–1000° C. in order to react the base material with the aluminium, to thereby form a diffusion layer.

To accomplish another object of the present invention, there is also provided an anticorrosive treatment method for a base material which is adopted as separating means, for use in a molten carbonate fuel cell including a manifold portion for making gases flow therethrough, electrodes and a gas sealing portion for sealing to prevent gases from leaking, the anticorrosive treatment method comprising the steps of:

coating the base material which is composed of a stainless steel plate and has a predetermined width with nickel by a predetermined thickness;

coating the nickel-coated base material with aluminium by a predetermined thickness; and thermally treating the base material coated with the nickel and aluminium for 1–5 hours in a hydrogen-atmosphere of 10–50% at temperatures of 600–1000° C. to thereby form a diffusion layer.

BRIEF DESCRIPTION OF THE DRAWINGS

The preferred embodiments are described with reference to the drawings wherein.

DETAILED DESCRIPTION OF THE PREFERRED EMBODIMENTS

Preferred embodiments of the present invention will hereafter be described in detail with reference to the accompanying drawings.

Figure 1:
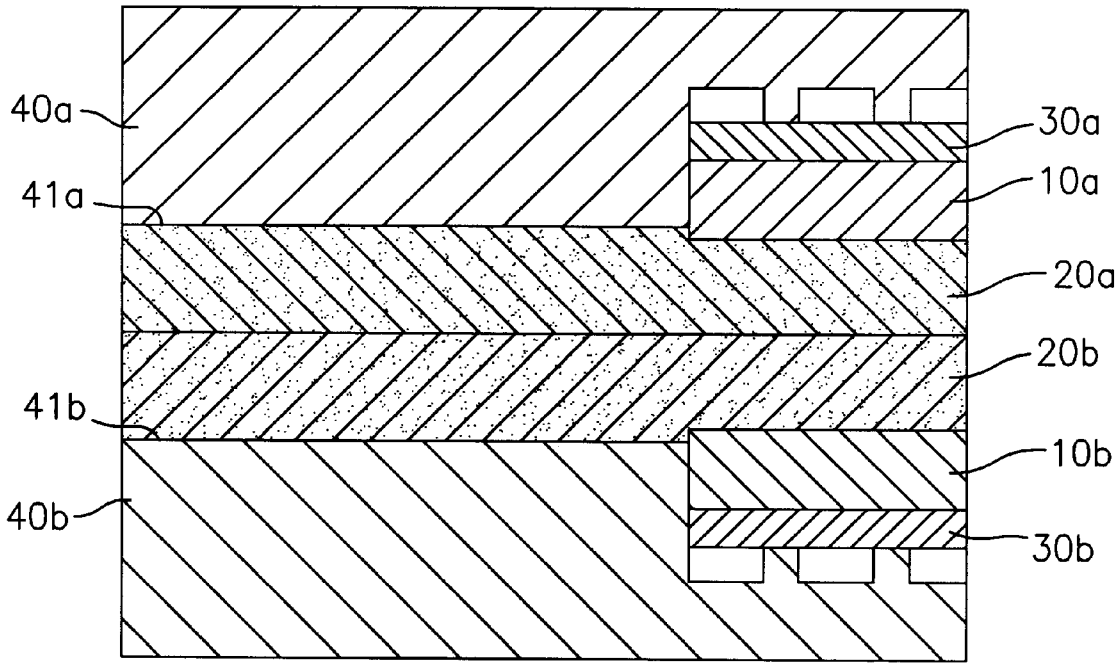
FIG. 1 shows a general molten carbonate fuel cell.
Figure 2:
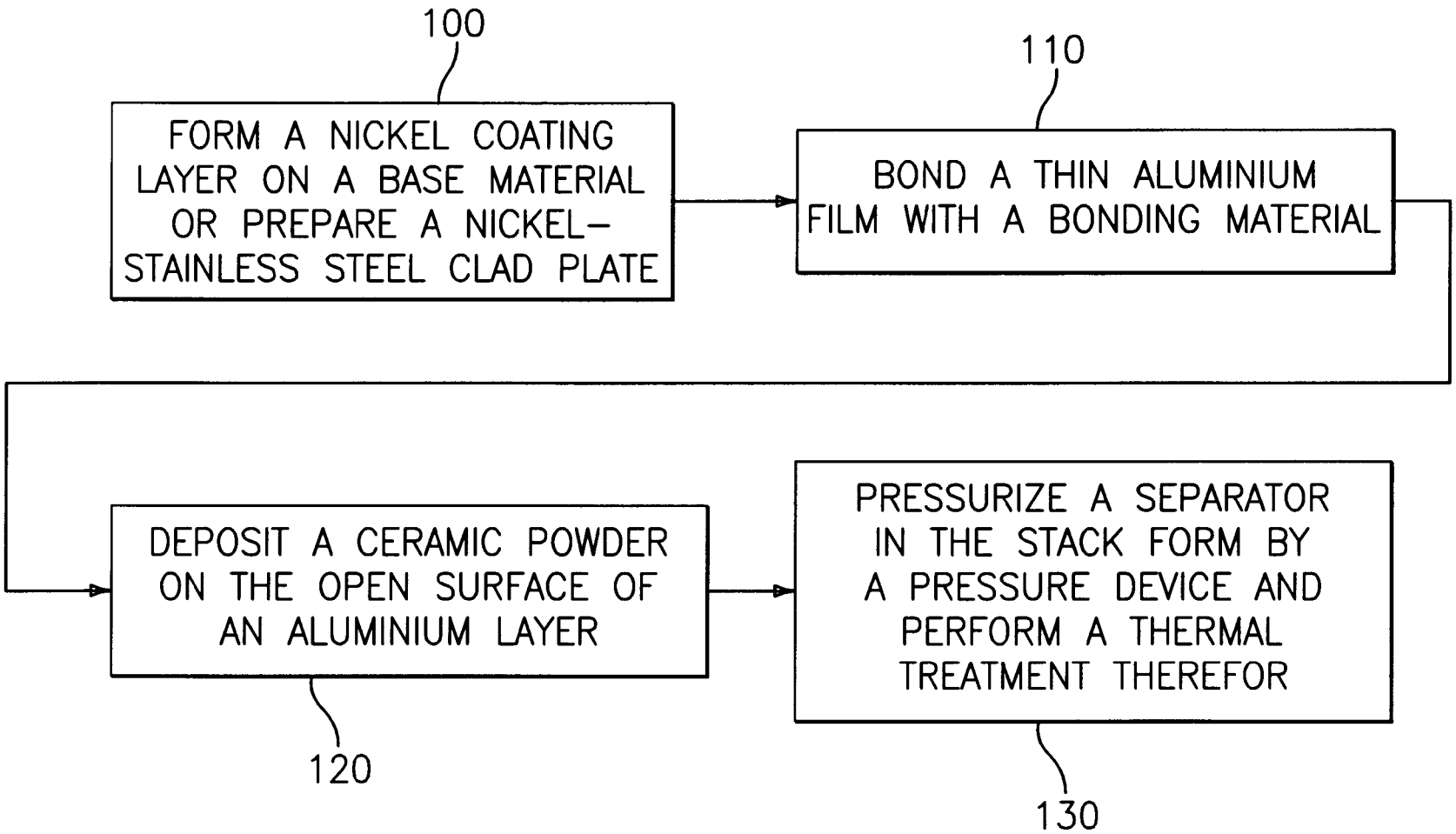
FIG. 2 is a flowchart diagram for explaining an anticorrosive treatment method for a separator according to an embodiment of the present invention.
Figure 3A:
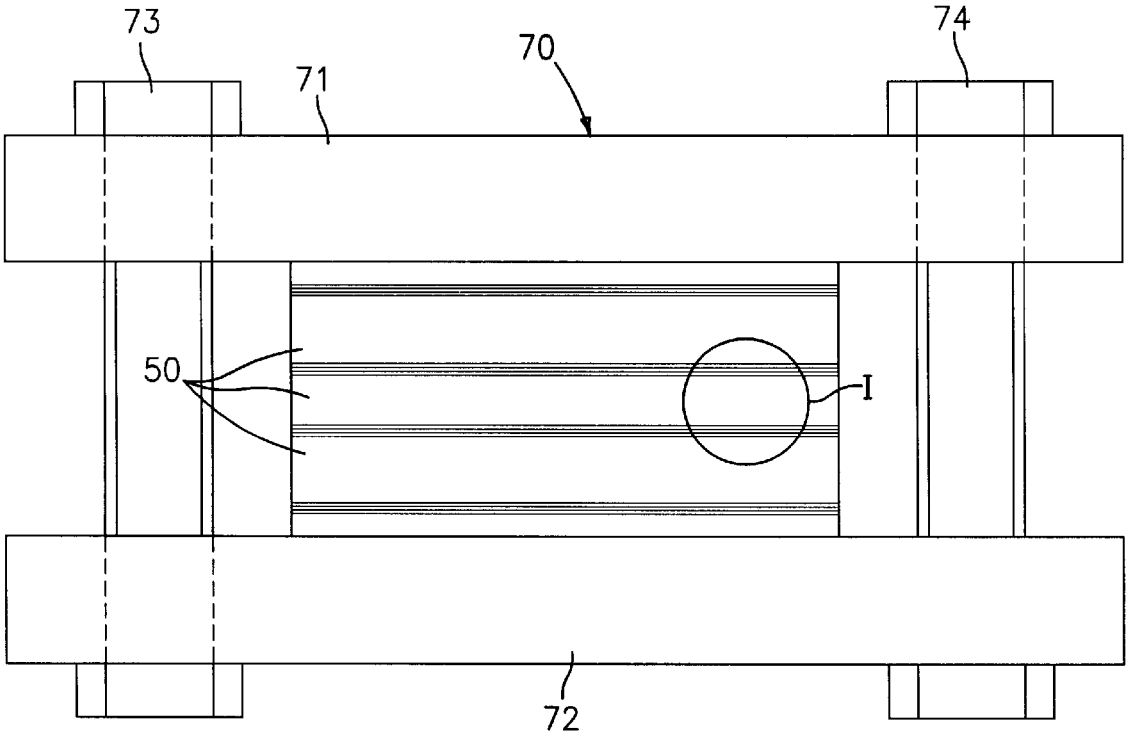
FIG. 3A shows an separator pressurized in the form of a stack according to the present invention, in which the separator is pressurized by a pressure device.
Figure 3B:
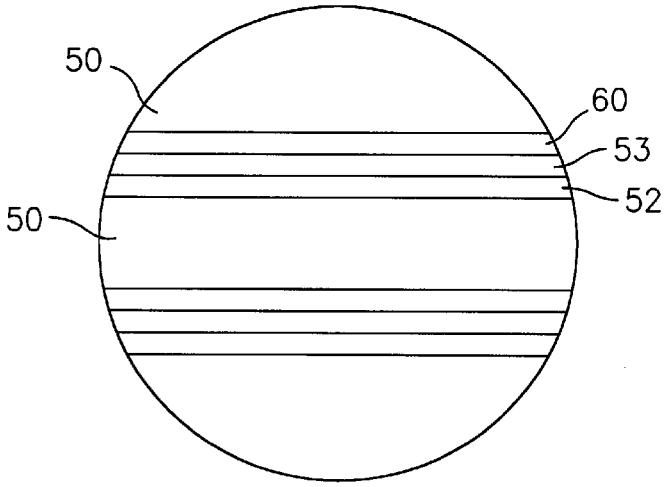
FIG. 3B is an enlarged view of the portion I of FIG. 3A.

First, a method, as an embodiment of the present invention, in which a thin aluminium film is bonded by a bonding material and then diffusion-coated by a thermal treatment will be described below. FIG. 2 is a flowchart diagram for explaining an anticorrosive treatment method for a separator according to an embodiment of the present invention. As shown in FIG. 2, to corrosion-protectively treat a wet-seal area of a separator, a base material denoted as a reference numeral 11 in FIG. 3B is electroplated with nickel by the thickness of about 5–20 μm to form a nickel coating layer 52. Otherwise, a nickel-stainless steel clad plate is prepared in step 100. A thin aluminium film 53 is bonded by the thickness of about 10–50 μm on the wet-seal area of the nickel plated base material or the clad steel plate, using a bonding material in step 110. In this case, a commercialized product is used as a thin aluminium film and a silver (Ag) paste is used as a bonding material. Also, a ceramic powder 60 is deposited on the open surface of the bonded thin aluminium film in step 120, which purposes to prevent diffusion of the aluminium toward the ceramic powder during thermal treatment in step 120. The major component of the ceramic powder is a high-mesh Al2O3 or BN (boron Nitride) powder, which is coated on the thin aluminium film by a uniform thickness. Moreover, as shown in FIGS. 3A and 3B, the separator 50 is deposited for a thermal treatment process in the stack form, and pressurized by a pressure device 70 composed of pressurizing plates 71 and 72 and tightening bolts 73 and 74 in step 130, to then be thermally treated. Here, the amount of the pressure becomes about 10–50 Kg/cm2. Thus, the separator pressurized in the stack form is thermally treated, in which a temperature rises up by the rate of 1–3° C. per minute up to 660–700° C. in a hydrogen-atmosphere furnace for 2–10 hours in step 1. It is preferable that the temperature risen up by the rate of 1° C. per minute is maintained for two hours. Under this process, aluminium is diffused into the nickel coating layer 52. In step 2, the thermal treatment is further performed at a temperature rising up by a rate of 1 through 3° C. per minute up to 900–1000° C. in a set hydrogen-atmosphere furnace for 2–10 hours. It is preferable that the temperature risen up by the rate of 1° C. per minute is maintained for about two hours. A diffusion process is performed via the above steps 1 and 2 to reinforce the bonding capability of the base material, the nickel and the aluminium, to thereby obtain a desired nickel-aluminium coated layer on the separator.

Figure 4:
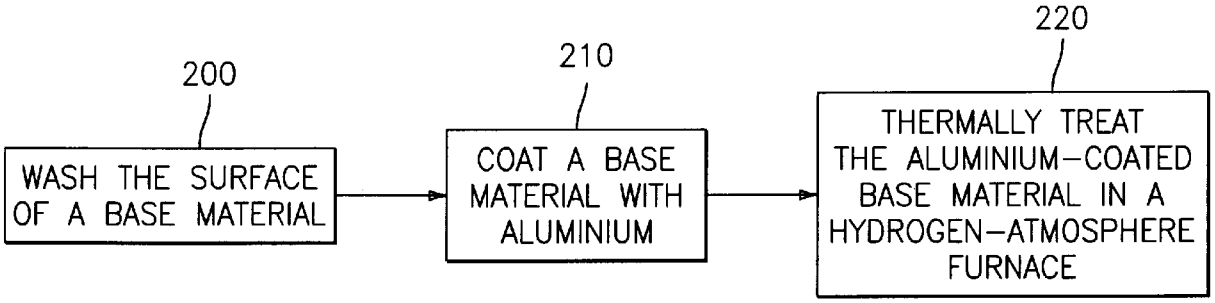
FIG. 4 is a flowchart diagram for explaining an anticorrosive treatment method for a separator according to another embodiment of the present invention.

As another embodiment of the present invention, aluminium is coated on the base material of stainless steel and then diffusion-processed to improve an anticorrosive capability with respect to the electrolyte, which will be simply described below with reference to FIG. 4. FIG. 4 is a flow-chart diagram for explaining an anticorrosive treatment method for an separator according to another embodiment of the present invention. As shown in FIG. 4, impurities such as oil and dust remaining on the surface of the stainless steel base material of the separator is washed cleanly with water, organic solvents, and acids in step 200. Then, aluminium is coated on the stainless steel plate in step 210. Here, there are a physical vapor deposition method, a slurry coating method and a spray coating method as the coating methods. As such, the base material coated with aluminium is thermally treated in a hydrogen-atmosphere (nitrogen balance) furnace, to make the base material and the aluminium to react, to thereby then form a diffusion layer in step 220. In such a manner, an anticorrosive coating is performed, whose detailed processes will be described below based on actual experimental data.

As one experimental example, impurities such as oil and dust remaining on the surface of the stainless steel plate 316L (hereafter called a base material) having the thickness of 1.2 or 2 mm is washed cleanly using water, organic solvents, and acids. Then, aluminium is coated on the base material in a vacuum furnace of 5×10−6torr using an ion sputtering method which is a kind of a physical vapor deposition method. Here, the thickness of the deposited aluminium is desirably 30–40 μm. The aluminium deposited base material is put in the furnace at hydrogen-atmosphere (nitrogen balance) of about 10% and is thermally treated at temperatures of 800–90° C. for about two hours. As a result, if the hydrogen atmosphere furnace is filled with nitrogen, the thermally treated base material is taken out to then remove the oxidized aluminium from the surface of the base material. The base material is cut into a test piece to identify the composition of the surface layer, and then surface-processed to then perform an element analysis of the surface of the base material. The thickness and composition of the analyzed surface layer are shown in Table 1. Also, to perform a corrosion experiment of the base material corrosion-protective-treated in such a manner, a carbonate powder having the composition of 62% by mole of Li2CO3 and 38% by mole of K2CO3 is deposited on the aluminium coated test piece and corroded for about two hours in the furnace of a temperature of 700° C. at a CO2 atmosphere. In the result of observing the surface of the test piece via a scanning electron microscope and an X-ray deflector (XRD) after completion of the corrosion experiments, the test piece which has been thermally treated at 800° C. or 900° C. are not corroded.

Also, as a comparative example of the above-described embodiment, the aluminium coated base material is thermally treated at 800° C. or 900° C. to then fabricate a test piece in the same manner as that of the above embodiment. The above two test pieces are also analyzed in the same manner as the above, to then perform a corrosion experiment. The analysis results are shown in Table 1. In the result of the corrosion experiments, the test pieces thermally treated at 800° C. or 900° C. reacts with the carbonate in their surface layers, to accordingly produce a lithiumaluminate, and corrode even a base material.

TABLE 1

| | | Embodiment | | Comparative example | |
|---|---|---|---|---|---|
| | | 800° C. thermal treatment | 900° C. thermal treatment | 600° C. thermal treatment | 900° C. thermal treatment |
| Outermost layer | Thickness (μm) | 22 | 39 | 20 | 8 |
| | Composition (wt %) | Al = 66<br>Fe = 25<br>Ni = 4<br>Cr = 5 | Al = 34<br>Fe = 49<br>Ni = 7<br>Cr = 10 | Al = 91<br>Fe = 7<br>Ni = 1<br>Cr = 1 | Al = 20<br>Fe = 49<br>Ni = 18<br>Cr = 31 |
| Second outermost layer | Thickness (μm) | 19 | 22 | 18 | 7 |
| | Composition (wt %) | Al = 55<br>Fe = 33<br>Ni = 5<br>Cr = 8 | Al = 5<br>Fe = 66<br>Ni = 8<br>Cr = 20 | Al = 87<br>Fe = 9<br>Ni = 2<br>Cr = 2 | Al = 7<br>Fe = 47<br>Ni = 16<br>Cr = 31 |

As described above, in the result of experiments, aluminium is coated by 10 μm thick or more on the stainless steel plate being a base material of the separator. Here, it is preferable that the optimal thickness of aluminium is 20–80 μm for the physical vapor deposition method, 100–500μm for the slurry coating method, 50–200 μm for the spray coating method. The aluminium coated base material is thermally treated for 1–20 hours in a hydrogen-atmosphere furnace (nitrogen balance) of 10–50% at temperatures of 600–1000° C., which makes the base material and the aluminum react to form a diffusion layer. In the thermal treatment and the time conditions of this case, a physical vapor deposition method is preferable at temperatures of 700–900° C. for 2–10 hours, and a slurry method is preferable at temperatures of 800–1000° C. for 5–20 hours, and a spray method is preferable at temperatures of 700–1000° C. for 1–5 hours.

Particularly, in the result of experiments, it is proved that an anticorrosive capability against carbonate is most excellent when after thermal treatment the composition of the aluminium surface layer consists of 40–80% by weight of aluminium, 20–50% by weight of iron, 5–10% by weight of nickel and 5–10% by weight of chromium. Thus, the separator fabricated by the above method is mounted on the fuel cell to maintain an anticorrosive capability even in the high temperature carbonate for a long time.

Figure 5:
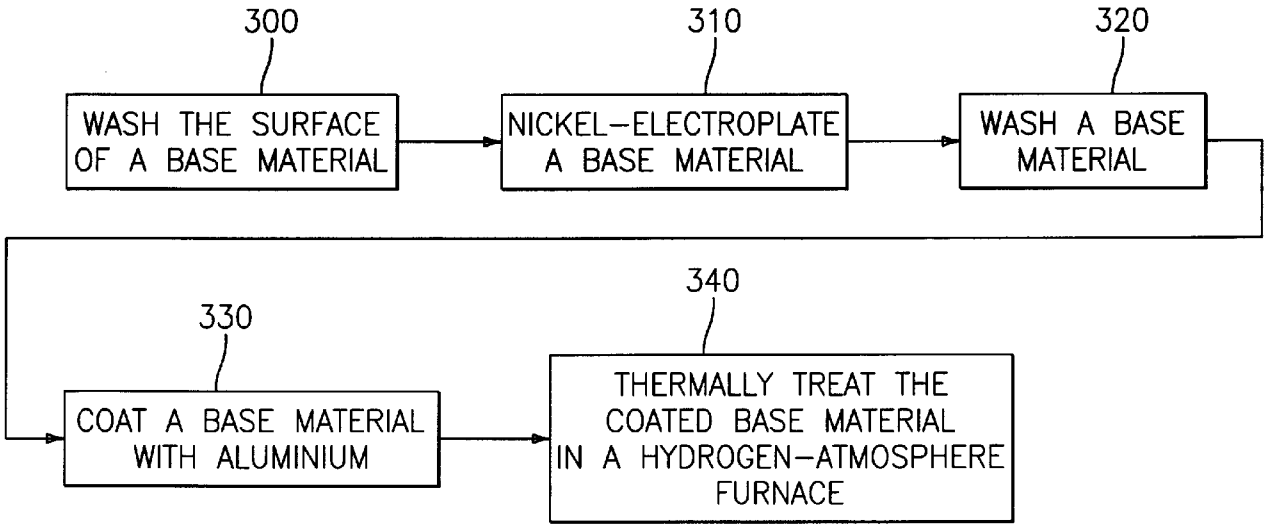
FIG. 5 is a flowchart diagram for explaining an anticorrosive treatment method for a separator according to further embodiment of the present invention.

As further embodiment of the present invention, nickel and aluminium are coated in turn on the base material of stainless steel and then diffusion-processed to improve an anticorrosive capability with respect to the electrolyte, which will be simply described below with reference to FIG. 5. FIG. 5 is a flowchart diagram for explaining an anticorrosive treatment method for a separator according to further embodiment of the present invention.

As shown in FIG. 5, impurities such as oil and dust remaining on the surface of the stainless steel plate which is a base material of the separator washed cleanly using water, organic solvents, and acids in step 300. The cleaned base material is put into a solution of the nickel sulfamate to perform a nickel-electroplate in step 310. The electroplated-base material is washed out in the above manner in step 320. Then, aluminium is coated on the base material of the stainless steel plate in step 330. The nickel-aluminium-coated base material is thermally treated in a hydrogen-atmosphere furnace (nitrogen balance) in step 340. For reference, if the nickel-aluminum coated separator is used for a fuel cell without being thermally treated, the aluminium is melted due to the melting point of 645° C. during the manufacturing processes of the fuel cells and reacts with the carbonate violently to cause the loss of the carbonate to deteriorate the performance of the cell. also, in the case when the coated thickness of the nickel is 2 μm or less or the coated thickness of the aluminium is 4 μm or less, the anticorrosive capability with respect to the carbonate is remarkably lowered. Moreover, if the thermal treatment temperature is 600° C. or below, a diffusion operation rarely occurs between the atoms of the aluminium-nickel and the base material. Although the separator is used for the fuel cell, the electrolyte is greatly consumed and corrosion occurs in the base material. Meanwhile, in the case when the thermal treatment temperature is 1000° C. or above, the base material deforms and surface layer thereof will be defective, to thereby cause the base material to corrode. Further, if the thermal treatment time is 10 minutes or shorter, a reaction between the aluminium and the base material does not happen properly. As described above, the anticorrosive coating is performed in the above manner, whose detailed processes will be described below based on actual experimental data.

As an experimental example, impurities such as oil and dust remaining on the surface of the stainless steel plate 316L (hereinafter called a base material) having a thickness of 1.2 or 2 mm is washed cleanly using water, organic solvents, and acids. Then, the cleaned base material is put into a nickel sulfamate solution to perform a nickel electroplating process of 2–5 μm thick. The electroplated base material is washed out in the above manner. Then, aluminium is coated on the base material in a vacuum furnace of 5×10−6 torr using an ion sputtering method which is a kind of a physical vapor deposition method. Here, the thickness of the deposited aluminium is desirably 10 μm or so. The aluminium deposited base material is put in the furnace at hydrogen of about 10% (nitrogen balance) and is thermally treated at 830 ° C. or so for about one hour. As a result, if the hydrogen-atmosphere furnace is filled with nitrogen, the thermally treated base material is taken out to then remove the oxidized aluminium from the surface of the base material. The base material is cut into a test piece to identify the composition of the surface layer, and then surface-processed to then perform an element analysis of the surface of the base material. The thickness and composition of the analyzed surface layer are shown in Table 1. Also, to perform a corrosion experiment of the base material corrosion-protective-treated in such a manner, a carbonate powder having the composition of 62% by mole of Li2CO3 and 38% by mole of $K_2CO_3$ is deposited on the aluminium coated test piece and corroded for about two hours in the furnace of a temperature 650° C. at a CO2 atmosphere. In the result of observing the surface of the test piece via a scanning electron microscope and an X-ray deflector (XRD) after completion of the corrosion experiments, the test piece which has been thermally treated at 800° C. or 90 ° C. are not corroded.

Also, as a comparative example of the above-described embodiment, the surface of the 1.2 or 2 mm steel plate (base material) is sand-blasted and the nickel powder is coated by the thickness of 20 μm or so using the spray coating method. Then, the aluminium is coated by the thickness of 70 μm or so via the spray coating method and then thermally treated at 830° C. These processes are same as those of the above-described embodiments. The thus-fabricated base material is analyzed in the same manner as that of the above embodiment. In the result of the anticorrosive capability, the base material is rarely corroded.

TABLE 2

| | | Embodiment | | Comparative example |
|---|---|---|---|---|
| | | Ni = 2 μm Al = 10 μm coating | Ni = 5 μm & Al = 10 μm coating | Ni = 20 μm & Al = 70 μm coating |
| Outermost layer | Thickness (μm) | 7 | 14 | 120 |
| | Composition (wt %) | Al = 41<br>Fe = 1<br>Ni = 58<br>Cr = 0 | Al = 35<br>Fe = 3<br>Ni = 61<br>Cr = 1 | Al = 64<br>Fe = 11<br>Ni = 18<br>Cr = 17 |
| Second outermost layer | Thickness (μm) | 5 | 8 | 44 |
| | Composition (wt %) | Al = 26<br>Fe = 53<br>Ni = 12<br>Cr = 9 | Al = 40<br>Fe = 44<br>Ni = 6<br>Cr = 10 | Al = 56<br>Fe = 31<br>Ni = 5<br>Cr = 8 |

As described above, it of experiments, nickel is coated by a predetermined thickness on the stainless steel plate which is the base material and then aluminium is also coated thereon. As the first method for performing such a lamination coating, nickel is electroplated by the thickness of 2 μm or more (optimally 5–20 μm) on the stainless steel plate, that is, the base material of the separator. Then, aluminium is coated by the thickness of 4 μm or more (optimally 10–60 μm ) by the physical vapor deposition method on the nickel coated base material. Also, as the second method, nickel is coated by the thickness of 5 μm or more (optimally 10–50 μm) using the spray coating method on the stainless steel plate. Then, aluminium is coated by the thickness of 10 μm or more (optimally 20–100 μm) using the spray coating method on the nickel coated base material. As such, after completion of the lamination coating, the resultant material is thermally treated for 10 minutes or more in a hydrogen-atmosphere (nitrogen balance) furnace of 10–50% at temperatures of 600–1000° C. (optimally 650–900° C.) so that the base material, the aluminium and the nickel react each other to form a diffusion layer. In the result of experiments, it is proved that an anticorrosive capability against carbonate is most excellent when after thermal treatment the composition of the nickel-aluminium surface layer consists of 25–75% by mole of aluminium, and 25–75% by mole of nickel. Thus, the separator fabricated by the above method is mounted on the fuel cell to maintain an anticorrosive capability even in the high temperature carbonate for a long time.

As described above, in the anticorrosive treatment method for a separator of a molten carbonate fuel cell, aluminium is coated on the base material or an thin aluminium film is bonded thereon to then perform a diffusion operation, which simplifies a manufacturing process and reduces manufacturing costs. Also, since the coating is accomplished by diffusion, a coating layer having an excellent anticorrosive capability and junction ability with respect to the base material can be obtained. The anticorrosive capability can be maintained even in the high temperature carbonate due to the long lifetime of the fuel cell. Also, in the case of the method of coating nickel and aluminium in turn on a base material and processing diffusion afterwards, the thermal treatment temperature can be relatively lowered to prevent deformation of the thin film such as the separator in the fuel cell to thereby improve durability.

While only certain embodiments of the invention have been specifically described herein, it will apparent that numerous modifications may be made thereto without departing from the spirit and scope of the invention.

What is claimed is:

1. An anticorrosive treatment method for a base material which comprises a separating means, for use in a molten carbonate fuel cell including a manifold portion for making gases flow therethrough, electrodes and a gas sealing portion for sealing to prevent gases from leaking, the anticorrosive treatment method comprising the step of:

plating a base material composed of a stainless steel plate with nickel;

bonding a thin aluminium film having a thickness of from about 5μm to about 20 μm on a gas sealing portion of the nickel-plated based material; and thermally treating the resultant material in a hydrogen gas atmosphere to form metal compound of the nickel and aluminium by diffusion at the junction surfaces between the base material, the nickel and the aluminium, wherein said thermal treatment is accomplished by a first thermal treatment step in which the temperature rises up to 660–700° C. and a second thermal treatment step in which the temperature then rises up to 900–1000° C.

2. The anticorrosive treatment method according to claim 1, wherein said thermal treatment is accomplished by said first and second thermal treatment steps in which, in hydrogen gas atmosphere, the temperature rises up by the rate of about 1–3° C. per minute, wherein said temperatures of 660° C.–700° C. and 900° C.–1000° C. are each maintained for about 2–10 hours.

3. The anticorrosive treatment method according to claim 1, wherein nickel which is plated on said base material has a thickness from 5 to 20 μm.

4. The anticorrosive treatment method according to claim 1, further comprising depositing a high-mesh ceramic powder on a surface of said thin aluminium film opposed to said base material to prevent aluminium from being diffused from the surface of said thin aluminium film opposed to said base material during the thermal treatment.

5. An anticorrosive treatment for a base material which comprises a separating means, for use in a molten carbonate fuel cell including a manifold portion for making gases flow therethrough, electrodes and a gas sealing portion for sealing to prevent gases from leaking, the anticorrosive treatment method comprising the steps of:

coating a base material which is composed of a stainless steel plate with aluminium to a thickness of 10–500 μm via a physical vapor deposition method, and thermally treating the resultant material for 1–20 hours in a hydrogen-atmosphere of 10–50% at temperatures of 600–1000° C. in order to react the base material with the aluminum, to thereby form a diffusion layer.

6. The anticorrosive treatment method according to claim 5, wherein the aluminium is coated at temperatures of 700–900° C. for 2–10 hours via a an ion sputtering method, and the coated aluminium has a thickness of 20–80 $\mu$m.

7. The anticorrosive treatment method according to claim 5, wherein the composition of a surface layer after thermal treatment consists of 40–80% by weight of aluminium, 20–50% by weight of iron, 5–10% by weight of nickel and 5–10% by weight of chromium.

8. An anticorrosive treatment method for a base material, which comprises a separating means for use in a molten carbonate fuel cell including a manifold portion for making gas flow therethrough. electrodes and a gas sealing portion for sealing to prevent gases from leaking, the anticorrosive treatment method comprising the steps of:

coating a base material which is composed of a stainless steel plate with aluminum to a thickness of 100–500 $\mu$m via a slurry method; and thermally treating the resultant material for 5–20 hours in a hydrogen atmosphere of 10–50% at temperatures of 800° C.–1000° C. in order to react the base material with the coated aluminum to thereby form a diffusion layer.

9. An anticorrosive treatment method for a base material which comprises a separating means, for use in a molten carbonate fuel cell including a manifold portion for making gases flow therethrough, electrodes and a gas sealing portion for sealing to prevent gases from leaking, the anticorrosive treatment method comprising the steps of:

coating a base material which is composed of a stainless steel plate with aluminium to a thickness of 50–200 $\mu$m via a spray method, and thermally treating the resultant mater 1–5 hours in a hydrogen-atmosphere of 10–50% at temperatures of 700–1000° C. in order to react the base material with the aluminium, to thereby form a diffusion layer.

* * * * *